US008406642B2

(12) United States Patent
Eck et al.

(10) Patent No.: US 8,406,642 B2
(45) **Date of Patent: *Mar. 26, 2013**

(54) REMOVING TONER FROM LONGITUDINAL MEMBER IN PRINTER

(75) Inventors: Edward M. Eck, Lima, NY (US); Alfred J. Gonnella, Rochester, NY (US); Anne F. Lairmore, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 242 days.

This patent is subject to a terminal disclaimer.

(21) Appl. No.: 12/826,876

(22) Filed: Jun. 30, 2010

(65) Prior Publication Data

US 2011/0299864 A1 Dec. 8, 2011

Related U.S. Application Data

(60) Provisional application No. 61/351,111, filed on Jun. 3, 2010.

(51) Int. Cl.
*G03G 15/00* (2006.01)
*G03G 21/00* (2006.01)
*G03G 15/09* (2006.01)

(52) U.S. Cl. ..... 399/43; 399/71; 399/99; 399/274

(58) Field of Classification Search ..... 399/43, 399/71, 99, 274

See application file for complete search history.

(56) References Cited

U.S. PATENT DOCUMENTS

| | | | | |
|---|---|---|---|---|
| 3,743,407 | A | 7/1973 | Smith | |
| 4,634,286 | A | 1/1987 | Pike | |
| 4,699,500 | A | 10/1987 | Lubberts et al. | |
| 5,394,224 | A * | 2/1995 | Irobe | 399/99 |
| 5,532,795 | A | 7/1996 | Tatsumi et al. | |
| 5,552,795 | A | 9/1996 | Tayloe et al. | |
| 6,385,415 | B1 | 5/2002 | Hilbert et al. | |
| 6,608,641 | B1 | 8/2003 | Alexandrovich et al. | |
| 6,775,505 | B2 * | 8/2004 | Stelter et al. | 399/267 |
| 6,959,162 | B2 | 10/2005 | Stelter et al. | |
| 7,120,379 | B2 | 10/2006 | Eck | |
| 7,343,108 | B2 | 3/2008 | Lairmore | |
| 7,426,361 | B2 | 9/2008 | Thompson et al. | |
| 7,502,581 | B2 | 3/2009 | Jacobs et al. | |
| 7,555,236 | B2 | 6/2009 | Saeki | |
| 7,577,383 | B2 | 8/2009 | Brown et al. | |
| 7,627,280 | B2 | 12/2009 | Sato | |
| 7,885,584 | B2 * | 2/2011 | Stern et al. | 399/273 |

(Continued)

FOREIGN PATENT DOCUMENTS

| | | |
|---|---|---|
| GB | 2 098 095 | 11/1982 |
| GB | 2282781 | 10/1994 |

OTHER PUBLICATIONS

M700 Report, Kodak Nexpress M700.

*Primary Examiner* — Joseph S Wong
(74) *Attorney, Agent, or Firm* — Christopher J. White

(57) ABSTRACT

Apparatus for removing toner after a selected time interval from a longitudinal member in a dry electrophotographic printer for printing a visible image on a receiver. An end block is disposed at one end of a rotatable development member, and a longitudinal member is disposed adjacent to the development member or photoreceptor and is connected to the end block. A backup bar is disposed adjacent to the photoreceptor and can selectively make physical contact with at least one point on the end block. When a measured time interval of printer operation reaches the selected time interval, a controller causes the backup bar to apply a selected force to the end block to cause toner on the longitudinal member to be removed from the member.

19 Claims, 12 Drawing Sheets

U.S. PATENT DOCUMENTS

2006/0133870 A1 6/2006 Ng
2011/0299865 A1* 12/2011 Eck et al. ..... 399/43
2011/0299877 A1* 12/2011 Eck et al. ..... 399/99

* cited by examiner

REMOVING TONER FROM LONGITUDINAL MEMBER IN PRINTER

CROSS-REFERENCE TO RELATED APPLICATIONS

Reference is made to commonly assigned, U.S. patent application Ser. No. 12/826,885 filed Jun. 30, 2010, entitled "PROCESS CONTROL WITH LONGITUDINAL MEMBER TONER REMOVAL" by Eck et al. (Published as U.S. 2011/0299865, Dec. 8, 2011), to co-pending U.S. patent application Ser. No. 12/751,011, filed Mar. 31, 2010, entitled "IMAGE PRINTING METHOD WITH REDUCED BANDING," by No (now U.S. Pat. No. 8,218,985, Jul. 10, 2012), and to U.S. Provisional Application Ser. No. 61/351,111 filed on Jun. 3, 2010, entitled "REMOVING TONER FROM SKIVE MOUNT IN PRINTER," by Eck, et al, the disclosures of which are incorporated by reference herein.

FIELD OF THE INVENTION

This invention pertains to the field of electrophotographic printing and more particularly to reducing artifacts caused by toner accretion.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. The direction perpendicular to the slow-scan direction is referred to as the fast-scan, cross-process, or cross-track direction. "Scan" does not imply that any components are moving or scanning across the receiver; the terminology is conventional in the art.

Various undesirable toner features (artifacts) can appear on prints produced by electrophotography. One type is a comet, which is a light splotch of toner (or, more generally, an area of increased density) spanning a restricted extent of the cross-track direction and extending a certain length in the in-track direction.

Longitudinal members adjacent to development rollers and photoreceptors can collect stray toner during operation. When the toner layer on the skive mount becomes thick enough, toner can fall off onto the development roller or photoreceptor, causing a comet artifact. Examples of longitudinal members include skive mounts and scavengers.

U.S. Pat. No. 5,532,795 to Tatsumi et al. describes cleaning rollers in a printer. GB2282781 describes cleaning elements urged into contact with the surface of a charging roller. However, these schemes can cause damage to the rollers, and are not applicable to stationary surfaces such as the surfaces of longitudinal members.

U.S. Pat. No. 7,555,236 describes cleaning a transfer drum electrostatically. Electrical bias is modified to clean. U.S. Pat. No. 5,552,795 describes engaging a secondary drum and modifying electrical signals to attract toner to a waste area. This is used to clean a transfer drum of developer or toner that has not transferred to a photoreceptor. However, the toner or developer deposited on a longitudinal member does not have a controlled charge, so electrostatic methods are not capable of reliably cleaning the longitudinal member.

U.S. Pat. No. 7,627,280 describes tubes for carrying waste through a printer. The waste is the developer which has escaped the normal development cycle and is transported to a removal container. However, this scheme is not useful for removing toner from a longitudinal member.

There is a continuing need, therefore, for a system for cleaning a longitudinal member to prevent comet artifacts.

SUMMARY OF THE INVENTION

According to the present invention, there is provided apparatus for removing toner after a selected time interval from a longitudinal member in a dry electrophotographic printer for printing a visible image on a receiver, comprising:

a) a rotatable photoreceptor for transferring the visible image comprising toner onto the moving receiver;

b) a rotatable development member arranged with respect to the photoreceptor to provide toner to the photoreceptor, and an end block disposed at one end of the rotatable development member;

c) a toner supply arranged with respect to the development member to apply a blanket of developer to the development member, wherein the developer includes toner;

d) a longitudinal member disposed adjacent to the development member or photoreceptor, connected to the end block, and extending along the width of the development member or photoreceptor;

g) a backup bar disposed adjacent to the photoreceptor, the backup bar operative in a first position to make physical contact with at least one point on the end block, so that the photoreceptor is retained in position with respect to the development member to receive toner from the development member, and operative in a second position to be spaced apart from the photoreceptor;

h) a timing device for measuring a time interval of printer operation; and i) a controller responsive to the timing device and effective when the measured time interval reaches the selected time interval to automatically cause the backup bar to be in the second position, then, after a selected time delay, to cause the backup bar to be in the first position, so that the backup bar applies a selected force to the end block to cause toner on the longitudinal member to be removed from such member.

In various embodiments, this invention advantageously mitigates comet artifacts without reducing throughput since the operation is done in conjunction with a process control patch. The invention does not require additional expensive hardware or additional moving parts. The invention is useful with various types of longitudinal members and photoreceptors. Controlled motion of a backup bar, development member, or photoreceptor causes a controlled avalanche of a sufficient amount of toner to prevent the visible artifact. Therefore, additional cleaning equipment for the longitudinal member is not required. Various embodiments can clean toner off multiple longitudinal members.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

The attached drawings are for purposes of illustration and are not necessarily to scale.

DETAILED DESCRIPTION OF THE INVENTION

As used herein, the terms "parallel" and "perpendicular" have a tolerance of ±5°. The terms "horizontal" and "vertical" refer to orientations in the figures shown, and do not require any particular orientation of any apparatus described.

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Figure 10:
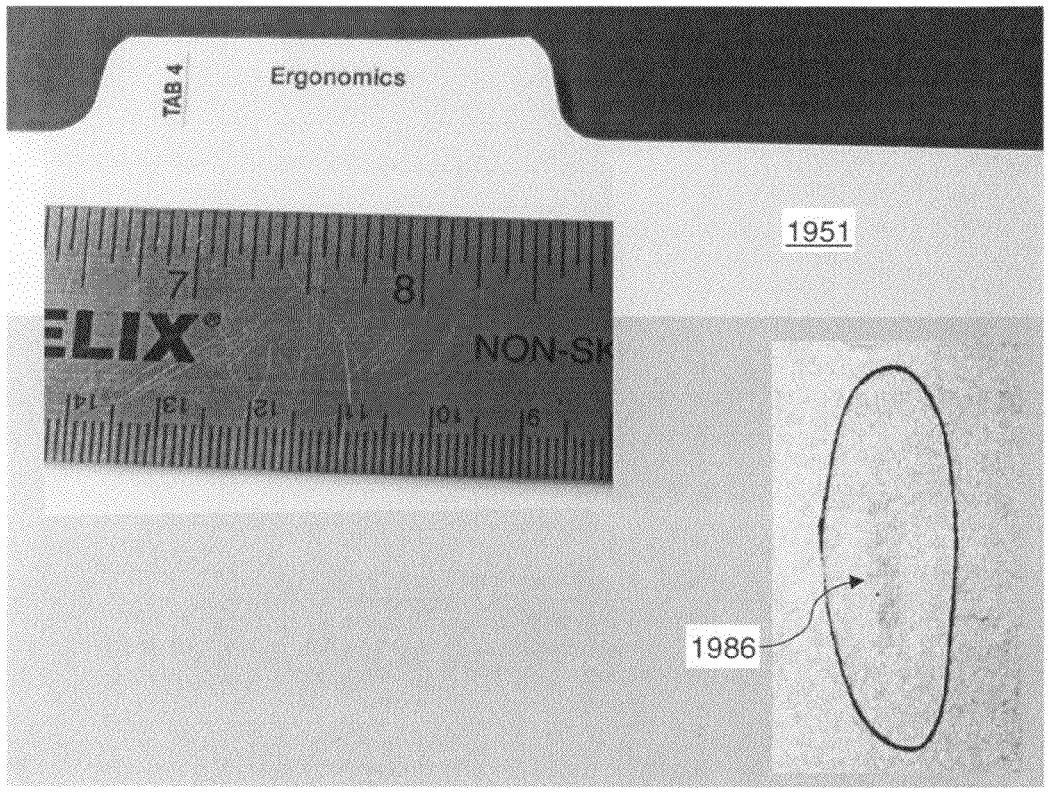
FIG. 10 is a photograph of a comet artifact.

FIG. 10 shows a photograph of a comet artifact (comet 1986). This figure was produced by photographing a comet artifact with a five megapixel digital still camera. The image was adjusted to make the comet artifact more visible. Specifically, the ADOBE PHOTOSHOP 7.0.1 Auto Color function was used. The image was desaturated to grayscale. A gradient fill approximately corresponding to the empty receiver was subtracted from the image to level the background. The area containing the comet was then adjusted using the Levels command. The input range was reduced and the output range was kept at 0-255 to apply gain to the comet and increase its visibility. The oval in the figure is a hand-drawn indicator of the location of the comet. A separate image of a ruler with the "Ergonomics" tab on the print was then superimposed to scale over the comet image (and desaturated) to show the size of comet 1986.

Comet 1986 is approximately 3 mm wide at its widest, and approximately 14 mm long. The vertical axis of the image (the 14 mm direction) is the in-track direction of the printer. The comet is more visible to the naked eye than it is in photographs, especially as it is in an area, and surrounded by an area, not intended to include any toner. The dark gray background of most of the image is an artifact of image-processing, and the actual print has a background of uniform density corresponding to area 1951.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, photoconductor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner and magnetic carrier particles, which can be electrically-conductive or -non-conductive. Toner particles can be magnetic or non-magnetic. The carrier particles can be larger than the toner particles, e.g. 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 1:
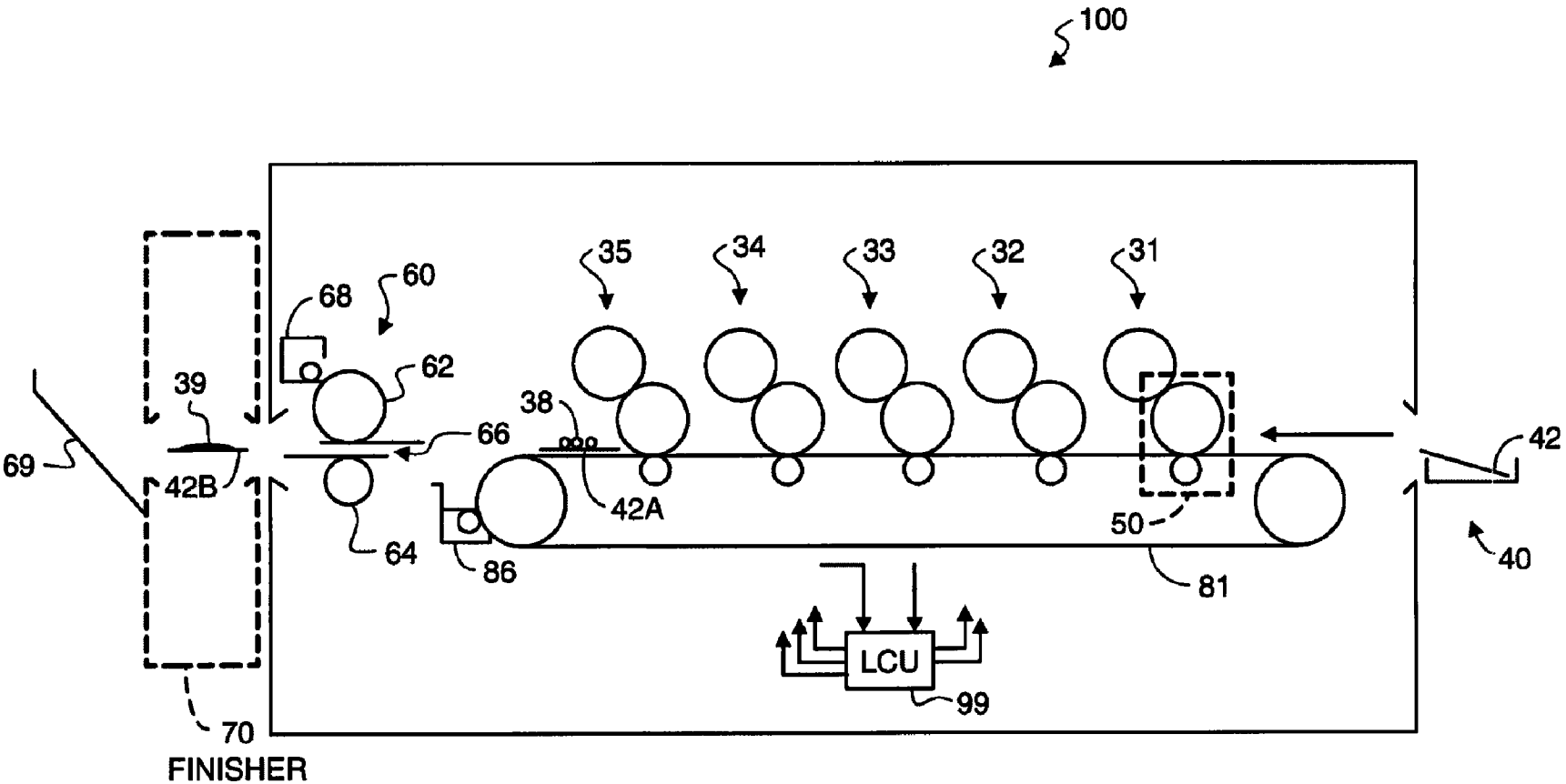
FIG. 1 is an elevational cross-section of an electrophotographic reproduction apparatus suitable for use with this invention.
Figure 2:
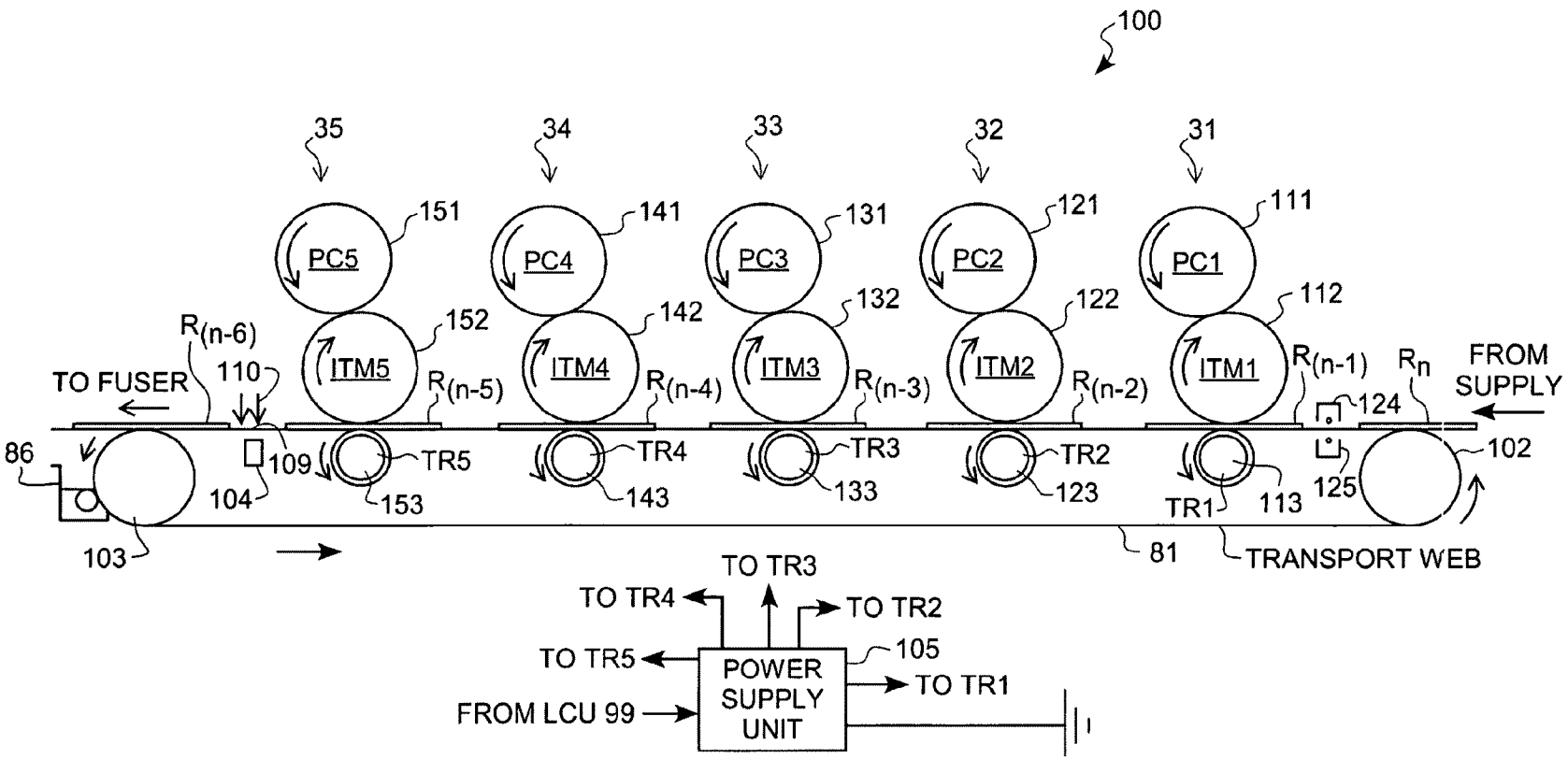
FIG. 2 is an elevational cross-section of the reprographic image-producing portion of the apparatus of FIG. 1.
Figure 3:
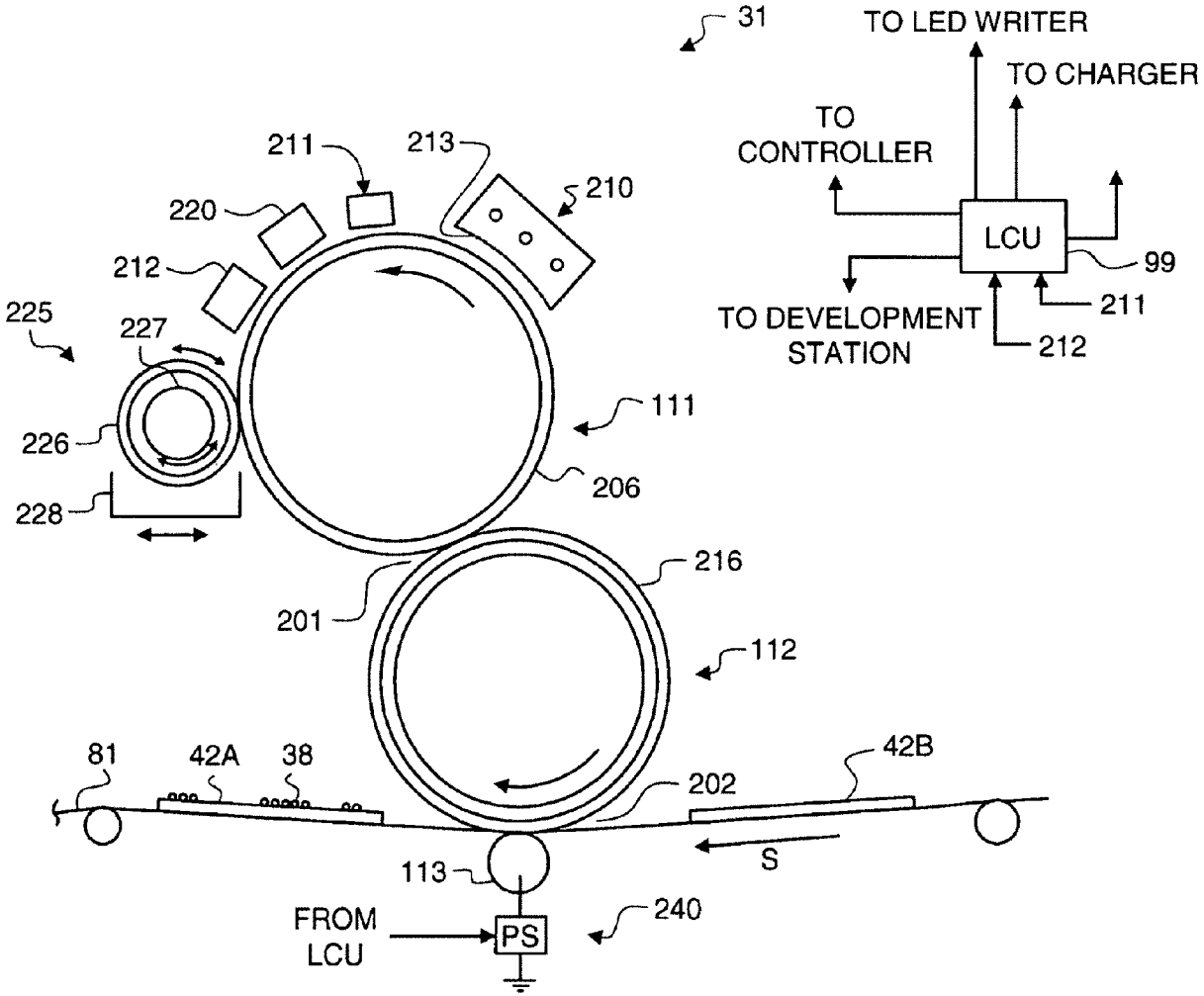
FIG. 3 is an elevational cross-section of one printing module of the apparatus of FIG. 1.

FIGS. 1-3 are elevational cross-sections showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g. fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g. a roller or belt, an intermediate transfer member (112, 122, 132, 142, 152), e.g. a blanket roller, and transfer backup member (113, 123, 133, 143, 153), e.g. a roller, belt or rod. Thus in printing module 31, a print image (e.g. a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40, is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Densitometer 104 is preferably located between printing module 35 and roller 103. Reflection densitometers, and more or fewer test patches, can also be used.

FIG. 3 shows more details of printing module 31, which is representative of printing modules 32, 33, 34, and 35. Primary charging subsystem 210 uniformly electrostatically charges photoreceptor 206 of imaging member 111, shown in the form of an imaging cylinder. Charging subsystem 210 includes a grid 213 having a selected voltage. Additional necessary components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g. laser or LED writers), and the respective development station 225 of each printing module 31, 32, 33, 34, 35, among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoreceptor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g. of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 which the light source (e.g. laser or LED) can expose with a selected exposure different from the exposure of another engine pixel. Engine pixels can overlap, e.g. to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, to apply toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g. a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets disposed around the circumference of magnetic core 227. Magnetic core 227 preferably provides a magnetic field of varying magnitude and direction around the outer circumference of toning shell 226. Developer or toner is supplied to toning shell 226 by sump 228, which is regularly replenished with toner (not shown). Sump 228 can include mixing augers (not shown) to maintain uniform toner loading across the width of toning shell 226. Further details of magnetic core 227 can be found in U.S. Pat. No. 7,120,379 to Eck et al., issued Oct. 10, 2006, the disclosure of which is incorporated herein by reference. Further details of sump 228 can be found in commonly-assigned U.S. Pat. No. 7,577,383 to Brown et al., the disclosure of which is incorporated herein by reference. Development station 225 can also employ a monocomponent developer comprising toner, either magnetic or non-magnetic, without separate magnetic carrier particles. In various embodiments, development station 225 can engage and disengage photoreceptor 206, e.g. by translating horizontally. This can be accomplished by a linear actuator or linear motor driving development station 225. In various embodiments, toning shell 226 and photoreceptor 206 are spaced apart when engaged by the nap height of developer on toning shell 226. It is known in the art to calculate the proper spacing between toning shell 226 and photoreceptor 206.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g. 42B) which receives the respective toned print images 38 from each printing module in superposition to form a composite image thereon. Print image 38 is e.g. a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Figure 4:
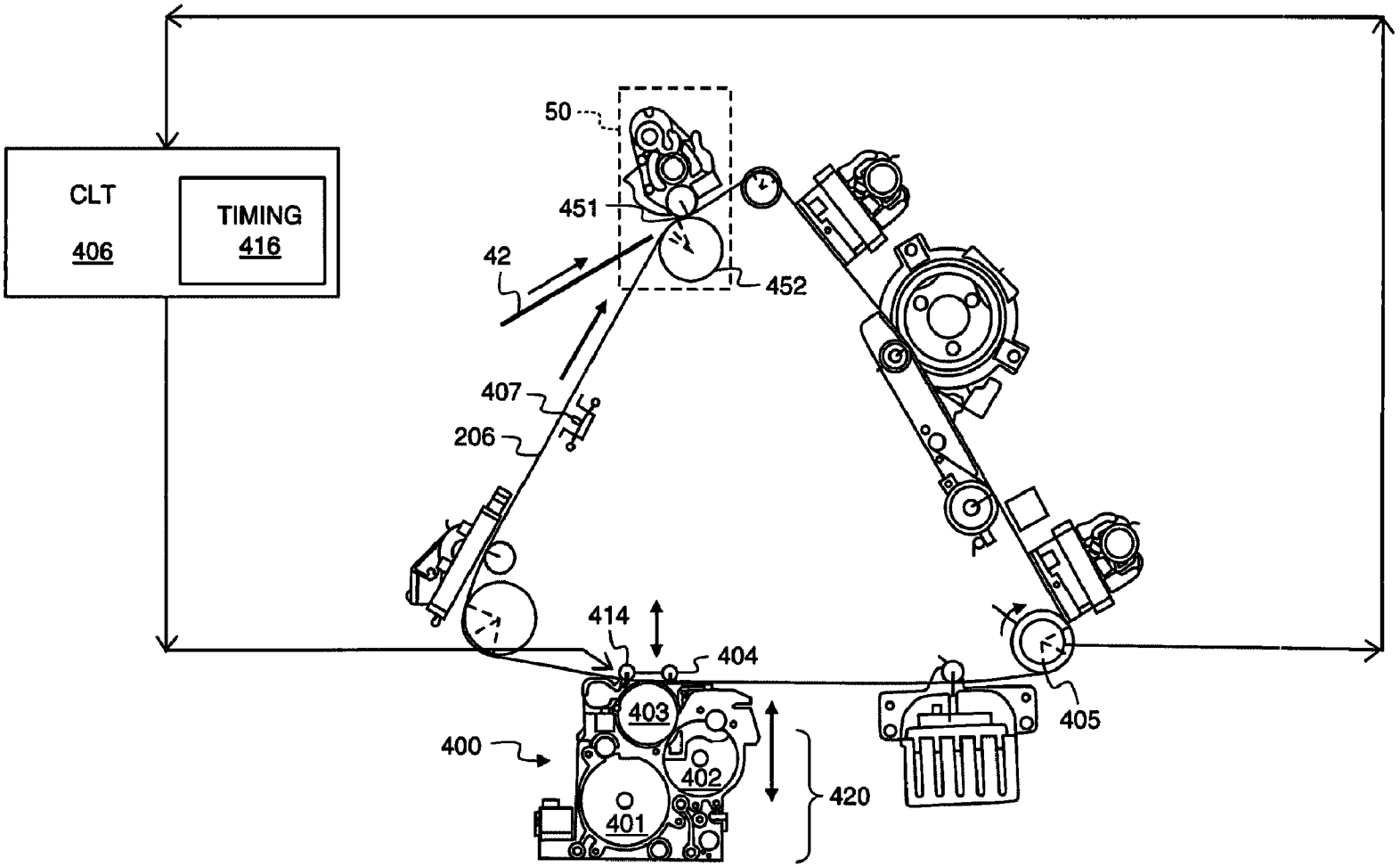
FIG. 4 is an elevational cross-section of another electrophotographic reproduction apparatus suitable for use with this invention.

FIG. 4 shows another embodiment of an electrophotographic printer useful with the present invention. Image loop 407 includes rotatable web (belt) photoreceptor 206 (FIG. 3) disposed over the side of image loop 407 closer to development member 403; a drum photoreceptor coated on or affixed to e.g. an aluminum cylinder can also be used. As used herein, the "width" of the photoreceptor is measured into the page on this view, i.e. across the image-bearing surface of the photoreceptor. For a cylindrical (drum) photoreceptor, the "width" is measured down the axis of the cylinder. Encoder 405 measures the distance traveled by loop 407 and provides that information to controller 406. Encoder 405 can be an optical, Hall-effect, or other encoder type known in the art. Controller 406 can be a CPU, FPGA, PLD, PAL, or other logic device implementing the functions described below. Controller 406 includes timing device 416 for measuring an interval of printer operation. Controller 406 can include LCU 99 (FIG. 1).

In an embodiment, photoreceptor 206 and image loop 407 can handle 6-A4 or 8.5" sheets plus the gaps or interframes between the sheets in one cycle of the image loop starting and ending at the splice. This is referred to as "6-frame mode." That is, a "frame" is the area of image loop 407 that can print one A4 or 8.5"×11" sheet. Photoreceptor 206 is present in each frame, but can be interrupted between frames. Image loop 407 includes 6 timing marks ("f-perfs"), one to start each image frame. Other modes, including 3-, 4-, and 5-frame, can be produced using encoder counts to interpolate between f-perfs. The printer can thus print 3, 4, 5 or 6 images or sheets of paper for each revolution of image loop 407 depending on the paper size in the in-track direction (around the loop). Not every frame is required to be occupied with a receiver in any given cycle. A process control frame as described below is preferably one frame of the smallest frame size, which is obtained in the 6-frame mode. Additional details of frames are found in U.S. Pat. No. 7,343,108 to Lairmore et al., the disclosure of which is incorporated herein by reference. The interval of printer operation discussed above can be measured in elapsed time, time the printer has been turned on (Hobbs time), number of pages printed, number of frames processed, number of encoder counts recorded, or number of f-perfs recorded.

Photoreceptor 206 transfers a visible image comprising toner, as described above, onto a moving receiver 42. Toning station 400 includes rotatable development member 403 arranged with respect to photoreceptor 206 to provide toner to photoreceptor 206. Toner supply 420 is arranged with respect to development member 403 to apply a blanket or nap of developer to development member 403. The blanket of developer is an aggregate of developer particles (i.e. toner particles and optionally developer particles) held by magnetic or electrostatic forces in proximity to the surface of development member 403. Toner supply 420 includes blender 401 for mixing toner and carrier particles to maintain uniform toner loading, and roller 402. In an embodiment, roller 402 is a bucket roller including a plurality of radial paddles adapted to push developer coming off blender 401 towards development member 403. In various embodiments, toner supply 420 can include a sump, feed roller, or feed auger. Bucket roller 402 can include a helix or not. In an embodiment, toner supply 420 includes a plurality of paddles on a non-helical roller.

Additional details of toning station 400 can be found in U.S. Pat. No. 7,426,361 to Thompson et al., the disclosure of which is incorporated herein by reference. In various embodiments, toning station 400 can engage and disengage photoreceptor 206, e.g. by translating vertically as indicated. In various embodiments, backup bars 404, 414 can move e.g. vertically to engage and disengage photoreceptor 206 and development member 403. Backup bars 404, 414 are discussed further below.

In another embodiment, toner supply 420 includes a ribbon blender. U.S. Pat. No. 4,634,286, the disclosure of which is incorporated herein by reference, describes a two-ribbon blender assembly useful with the present invention. An outer ribbon moves developer material toward the center of the toning station. An inner ribbon moves developer material from the center toward the ends of the toning station. This produces effective mixing between inward-flowing and outward-flowing material. In another embodiment, the ribbon blender includes an inner helical ribbon to move developer generally along the axis of the blender in one direction, and an outer helical ribbon to move developer generally along the axis of the blender in another direction.

Backup bars 404, 414 hold image loop 407 in position with respect to development member 403 so that photoreceptor 206 (disposed on the opposite side of image loop 407 from backup bars 404, 414) can receiver toner from development member 403 to develop the latent image into a visible image on photoreceptor 206. Backup bars 404, 414 are moveable, as is discussed further below. Receiver 42 receives the visible image from photoreceptor 206 in transfer subsystem 50 to form the print image. Transfer subsystem 50 includes transfer roller 451 and registration roller 452, which together form a nip through which receiver 42 and photoreceptor 206 pass to transfer toner. Backup bars 404, 414 are disposed adjacent to photoreceptor 206. That is, they are close enough to photoreceptor 206, even if not in contact with it, to selectively retain photoreceptor 206 in its operational relationship with development member 403, as discussed further below.

By applying an impulse to a longitudinal member e.g. at a time when no receiver is passing through the printer, or during a frame which does not contain an image to be transferred to a receiver (a "skip frame"), toner is dislodged from the longitudinal member without causing artifacts on the receiver. The impulse can be applied periodically to prevent artifacts. In an embodiment, the impulse is applied during a process-control frame. This is discussed further below.

Figure 5:
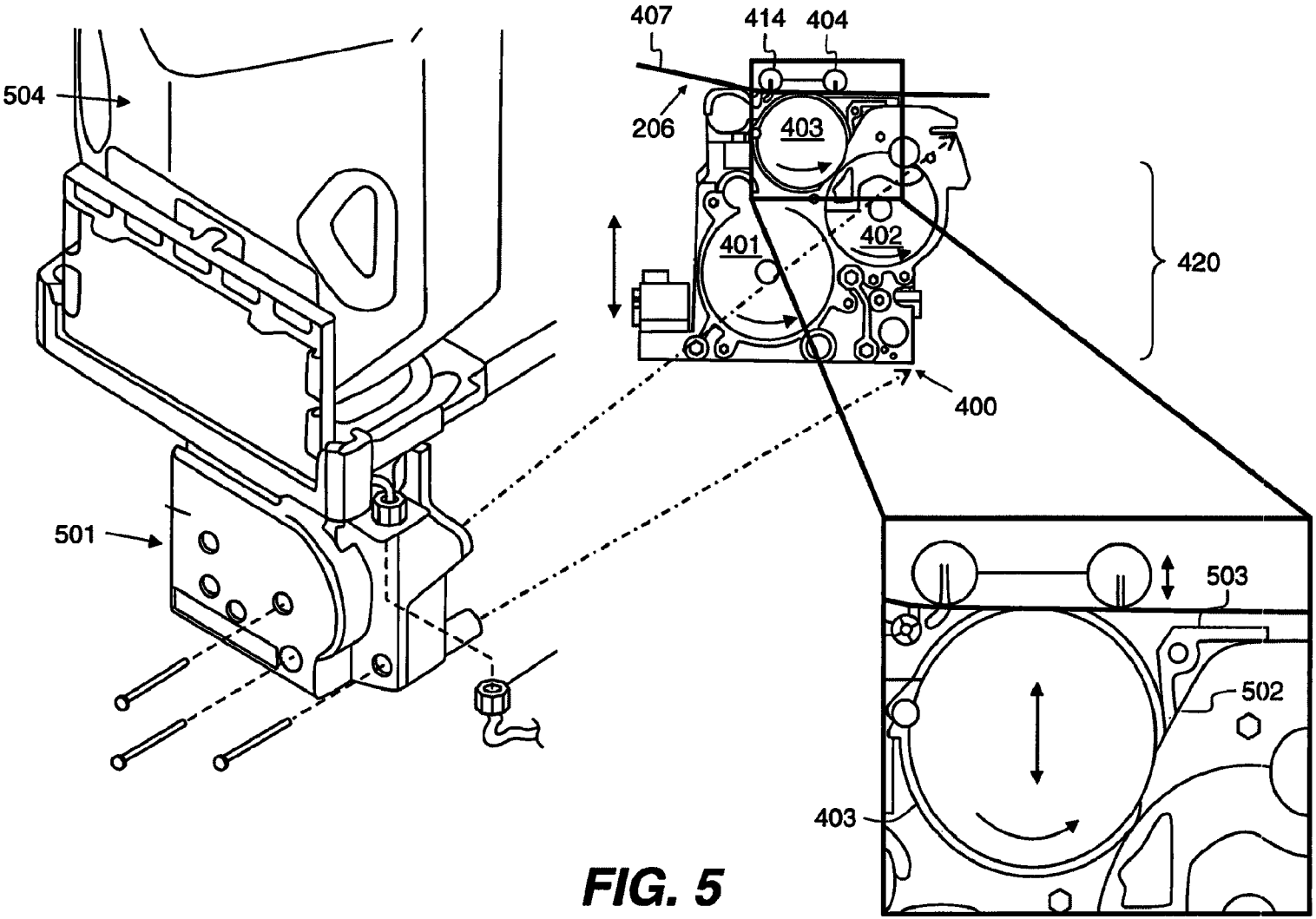
FIG. 5 shows detail of the toning station of FIG. 4 and associated components.

FIG. 5 shows more detail of toning station 400 and toner supply 420 according to an embodiment. In this and subsequent figures, "AY" stands for "assembly." Backup bars 404, 414, image loop 407, and photoreceptor 206 are as described above with respect to FIG. 4. Toner bottle 504 is attached by the operator of the printer to replenisher assembly 501. Replenisher assembly 501 extends the length of blender 401 to provide toner and developer along the full width of photoreceptor 206. Bucket roller 402 is as shown in FIG. 4. Bucket roller 402 applies a blanket of developer to development member 403, the blanket having a variable thickness. To provide more consistent toning, skive 502 is disposed adjacent to development member 403 between toner supply 420 and photoreceptor 206 in the direction of rotation of development member 403. Skive 502 is spaced apart from development member 403 by a selected nap height to reduce the height (thickness) of the blanket of developer to the selected nap height. That is, skive 502 is a metering skive. The metering skive controls the amount of developer per unit time passing the skive 502, since the magnetic core of the development station controls the density of developer being skived by providing a magnetic field of the correct shape and magnitude. That is, the metering skive, which can extend the length of the development roller, controls the quantity of developer material delivered from the toner supply to the development zone, as described in U.S. Pat. No. 7,502,581, U.S. Pat. No. 6,959,162, and U.S. Pat. No. 6,385,415, the disclosures of which are incorporated herein by reference. Other types of skive can be employed with the present invention, as will be obvious to those skilled in the art. Skive mount 503 is disposed adjacent to development member 403 and connects skive 502 to end block 601 (FIG. 6A).

Skive mount 503 is an example of a longitudinal member. A longitudinal member is disposed adjacent to development member 403 or photoreceptor 206, and extends along the width of development member 403 or photoreceptor 206. That is, the longitudinal member has a greater extent along the direction of the width of development member 403 or photoreceptor 206 than along any direction perpendicular to the direction of that width. The longitudinal member can be as long as development member 403 or photoreceptor 206, or some non-zero percentage (<100% or >100%) thereof. By "adjacent to" it is meant that the longitudinal member is close enough to development member 403 or photoreceptor 206 to collect toner which escapes from the normal development process.

As indicated, toning station 400, development member 403, or backup bars 404, 414 can move e.g. vertically to engage or disengage development member 403 and photoreceptor 206 (FIG. 4). When development member 403 and photoreceptor 206 are engaged, they are retained in position with respect to each other so that photoreceptor 206 can receive toner from development member 403 to develop the latent image into the print image.

Figure 6A:
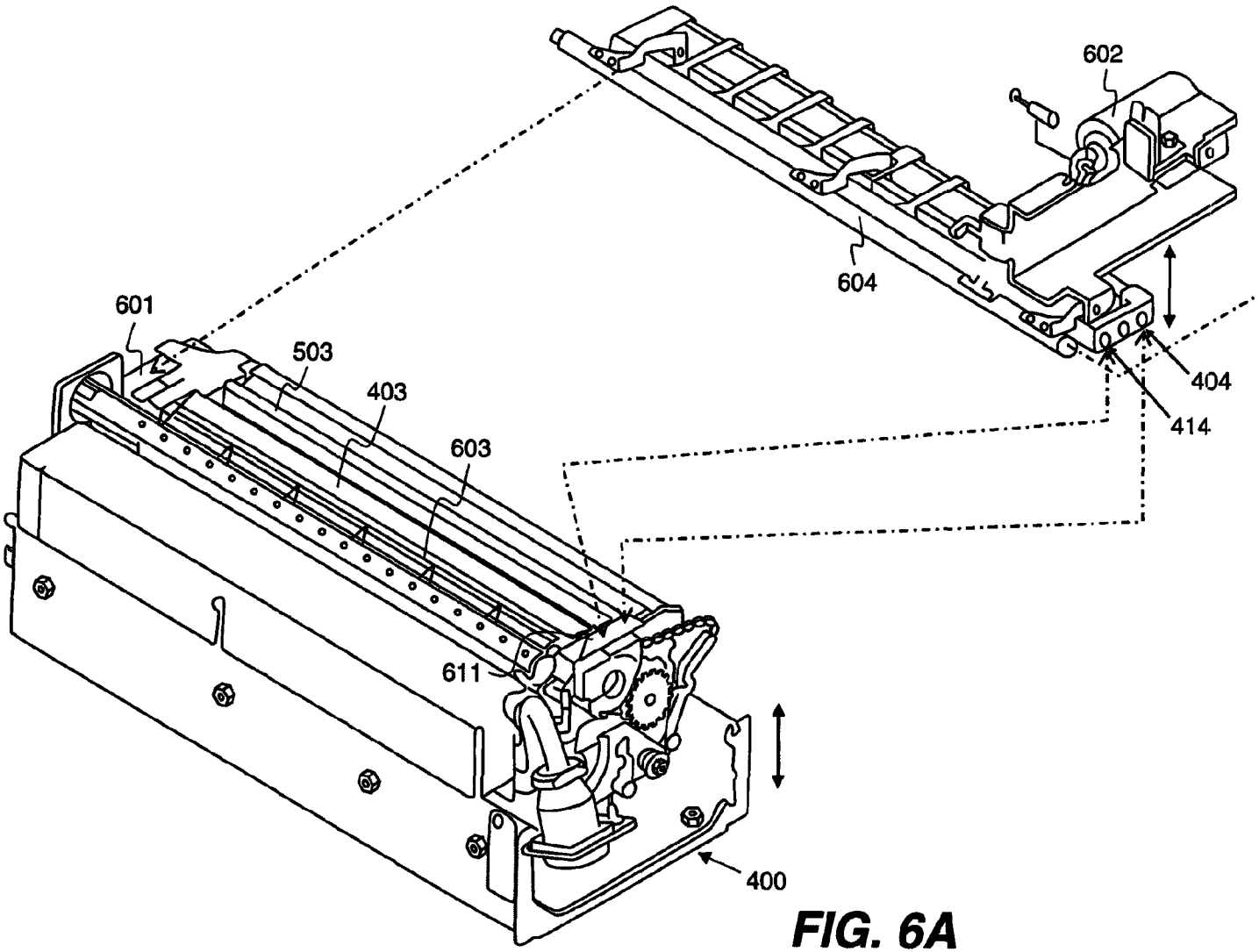
FIG. 6A shows an isometric view of the toning station of FIG. 4 and associated components.

FIG. 6A shows an isometric view of toning station 400. End block 601 is disposed at one end of development member 403. In an embodiment, second end block 611 is disposed at the opposite end of development member 403 from end block 601. In an embodiment, toning station 400, including end blocks 601, 611 can move vertically to engage and disengage photoreceptor 206 (FIG. 5).

In operation, toner can collect on skive mount 503, which is a longitudinal member. This toner is removed from skive mount 503, which can be a metering skive mounting plate, after a selected interval. The interval is selected so that the toner build-up on skive mount 503 is not enough to cause spontaneous avalanches of toner onto development member 403 before the controlled avalanche caused at the selected interval. The controlled avalanche is caused by a mechanical impulse exerted on end block 601 or end block 611. A printer can include one or more longitudinal members, and one or more end blocks or sets of end blocks. The discussion herein applies for any longitudinal member. To remove toner from a given longitudinal member, impulse is applied to an end block connected to that longitudinal member.

Backup assembly 604 includes backup bars 404, 414. Backup assembly 604 and solenoid 602 will be discussed further below with respect to FIG. 7. As shown, backup assembly 604 can move vertically to engage and disengage photoreceptor 206 and development member 403.

Internal scavenger 603 includes a conductive longitudinal member, or a conductive coating over a non-conductive longitudinal member, extending the width of photoreceptor 206. Internal scavenger 603 has a bias voltage applied so that it attracts carrier particles that have become attached to photoreceptor 206. Carrier particles are charged when toner particles are ripped away from them during toning, so can be attracted by an electric field. Developer is therefore attracted to internal scavenger 603 by design, and additional developer can collect on internal scavenger 603 during operation.

Figure 6B:
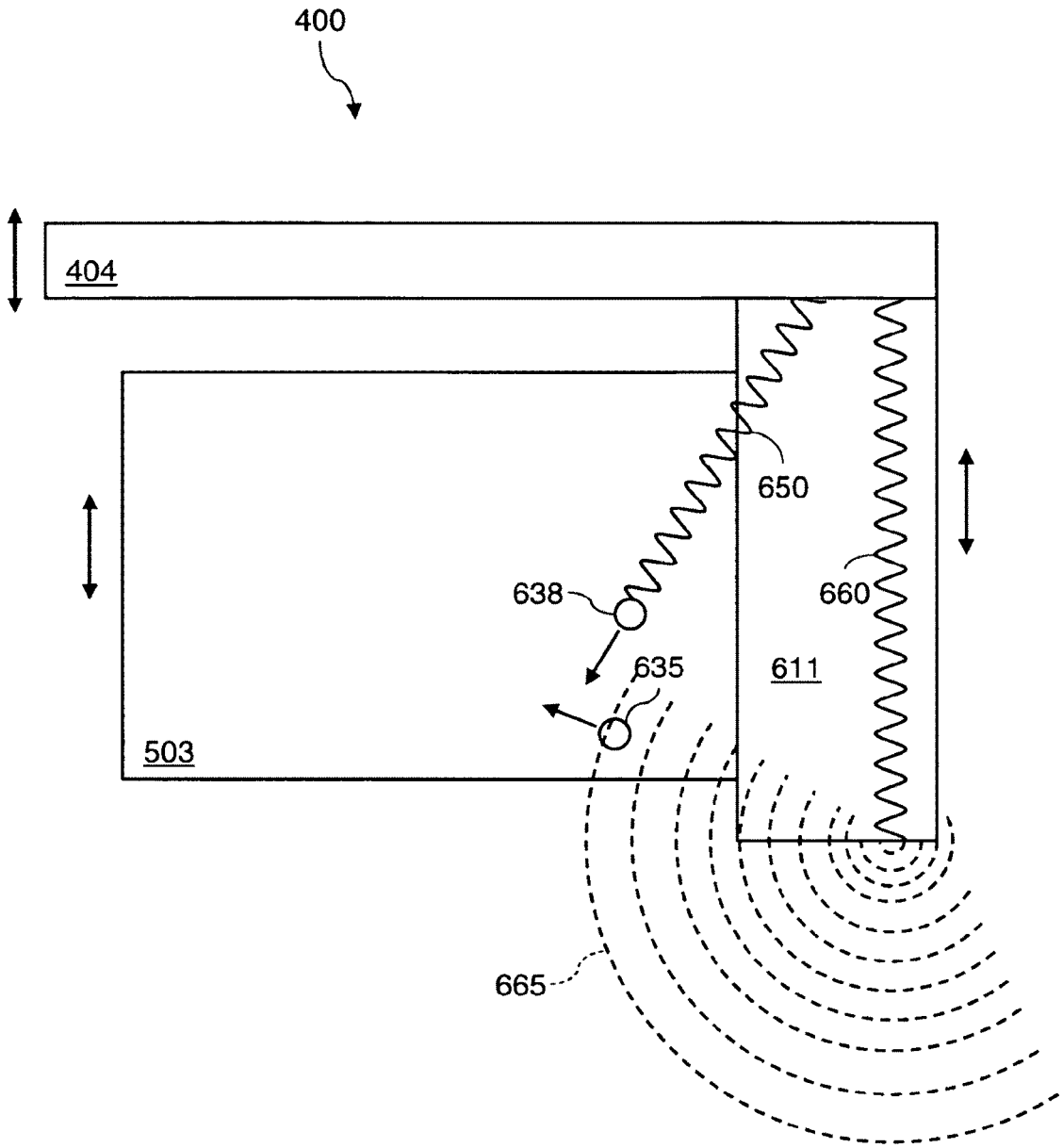
FIG. 6B shows an elevation of the toning station of FIG. 4 and associated components.

FIG. 6B shows an elevation of toning station 400 of FIG. 4 and associated components. Backup bar 404, end block 611, and skive mount 503 are as shown in FIG. 6A. As shown, backup bar 404, skive mount 503, and end block 611 can move vertically to engage and disengage photoreceptor 206 and development member 403.

Backup bar 404 is shown in physical contact with end block 611. When backup bar 404 applies a selected force to end block 611, e.g. by striking it, mechanical wave 650 travels through end block 611 into skive mount 503 and strikes toner 638, dislodging it from skive mount 503. Mechanical wave 660 travels through end block 611 and causes a corresponding mechanical wave 665 to be created in the air (or nitrogen, helium, oil, or other fluid surround) around end block 611. Mechanical wave 665 strikes toner 635, dislodging it from skive mount 503. Toner 635 and 638 can be individual toner particles or agglomerations of toner particles. Other debris, such as carrier particles from a two-component developer, can also be dislodged from skive mount 503 by a mechanical wave.

Mechanical waves (e.g. 650, 660) can have a variety of frequency components and can be an acoustic wave, pressure wave, longitudinal wave, surface wave, transverse wave, or other mechanical wave that propagates through end block 601 and skive mount 503. Mechanical waves in air caused by the vibration or motion of end block 601, backup bars 404, 414, or skive mount 503 due to the applied impulse from backup bar 404 can also travel through the air to the toner on skive mount 503 and result in toner being dislodged or removed. Any number or type of mechanical waves can be present. For clarity, only three mechanical waves are shown in FIG. 6B. Mechanical wave 665 has a spherical or hemispherical wavefront; for clarity, only part of the expanding wavefront is shown.

Specifically, in various embodiments, when backup bar 404 applies a selected force to end block 601, a mechanical wave is created in end block 601 and the mechanical wave travels through end block 601 into skive mount 503 to remove the toner. In various embodiments, when backup bar 404 applies a selected force to end block 601, a mechanical wave is created in end block 601 and a corresponding mechanical wave is created in the air adjacent to end block 601, and the mechanical wave in the air travels towards the skive mount 503 to remove the toner. In an embodiment, solenoid 602 applies force to backup bars 404, 414, causing them to apply force to end blocks 601, 611 when they hit end blocks 601, 611 at the end of their travel. The resulting change in momentum $\Delta p$=the momentum p of the backup bars at the instant before contact, since velocity and thus momentum go to zero after contact. $\Delta p = F\Delta t$, assuming constant force (constant deceleration) applied over the time interval required to stop the backup bars.

Referring back to FIG. 4, backup bars 404, 414 are disposed adjacent to image loop 407 and thus adjacent to photoreceptor 206. In an embodiment, backup bars 404, 414 are on the opposite side of photoreceptor 206 from development member 403. In an embodiment, backup bars 404, 414 are on the opposite side of image loop 407 from photoreceptor 206. The discussion herein with respect to backup bar 404 also applies to backup bar 414; one or more backup bars can be used. In embodiments using two backup bars 404, 414, the backup bars are arranged parallel to each other and are spaced apart from each other. The operation of backup bar 414 corresponds to the operation of backup bar 404. For example, when backup bar 404 moves, backup bar 414 moves correspondingly. Backup bar 404 is operative in a first position, shown here (and at first position 404*a* in FIG. 7), to make physical contact with at least one point on end block 601 (FIG. 6A). Backup bar 414 is likewise operative in first position 414*a*.

When backup bars 404, 414 make contact with end blocks 601, 611, development member 403 and photoreceptor 206 are engaged in an operational relationship. That is, they are retained in position with respect to each other so that photoreceptor 206 can receive toner from development member 403 to develop the latent image into the print image. It is known in the art that development member 403 and photoreceptor 206 can be spaced apart from each other by a distance not greater than the nap height of developer generated by a magnetic brush, so that developer held magnetically to development member 403 can contact photoreceptor 206. This permits the electrostatic attraction of toner particles to the latent image to develop it into the print image. The spacing can be selected by one skilled in the art. For example, commonly-assigned U.S. Pat. No. 6,959,162 to Stelter et al., the disclosure of which is incorporated herein by reference, describes experiments performed with a nap height of approximately 48 mils and a spacing from the surface of development member 403 to an aluminum receiver (analogous to photoreceptor 206) of 30 mils.

Figure 6C:
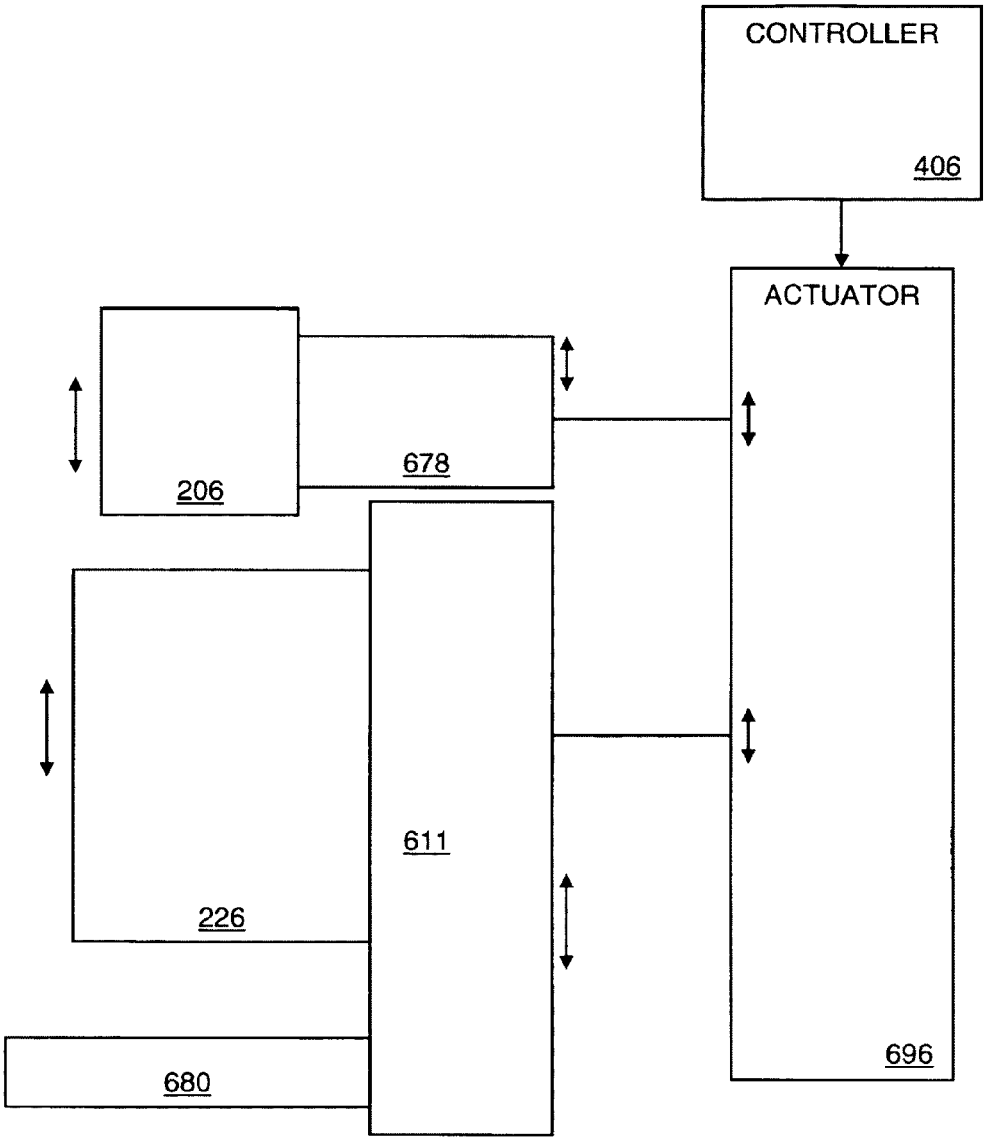
FIG. 6C shows an elevation of the printing module of FIG. 3 and related components according to an embodiment of the present invention.

FIG. 6C shows an elevation of the printing module of FIG. 3 and related components according to an embodiment. Photoreceptor 206 and toning shell 226 are as shown in FIG. 3. Controller 406 is as shown in FIG. 4. End block 611 is as shown in FIG. 6A. Longitudinal member 680 is mechanically connected to end block 611 and moves with it.

In an embodiment, end block 611 protrudes vertically beyond toning shell 226. In an embodiment, end block 611 is coaxial with toning shell 226 and mounted on the same axle. Stop 678 is disposed at one end of photoreceptor 206. In an embodiment, stop 678 is coaxial with photoreceptor 206 and mounted on the same axle. In an embodiment, photoreceptor 206 protrudes vertically beyond stop 678. In an embodiment, stop 678 protrudes vertically beyond photoreceptor 206, and toning shell 226 protrudes vertically beyond end block 611. In various embodiments, stop 678 and end block 611 are hard plastic, aluminum, or rubber. Compliance of stop 678 and end block 611 can be selected by one skilled in the mechanical art to maintain a desired spacing between photoreceptor 206 and toning shell 226 when stop 678 and end block 611 are in mechanical contact at one or more point(s).

Actuator 696 vertically moves photoreceptor 206 and stop 678 together, and vertically moves toning shell 226 and end block 611 together. End block 611 and stop 678 prevent photoreceptor 206 and toning shell 226 from coming into physical contact with each other. Actuator 696 can include pistons, solenoids, servomotors, stepper motors, gears, and other components known in the art. By moving the connected components with respect to each other, actuator 696 selectively causes photoreceptor 206 to be spaced apart from development member 403 or to be brought into operational relationship with development member 403 to receive toner, as described above.

In an embodiment, actuator 696 includes two linear actuators, each with a motor driving a leadscrew and a nut riding on the screw and connected to the driven element. One actuator drives photoreceptor 206 and stop 678 vertically in either direction, and the other actuator drives toning shell 226 and end block 611 vertically in either direction. In other embodiments, photoreceptor 206 and stop 678 are stationary and are not driven, or toning shell 226 and end block 611 are stationary and are not driven. That is, one of the stop or the end block is a movable member and the other is a stationary member. In an embodiment, actuator 696 includes a solenoid (not shown) controlled by controller 406 and connected to the movable member to operate the movable member.

In an embodiment, when stop 678 and end block 611 apply the selected forces against each other, a mechanical wave is created in end block 611 and the mechanical wave travels through end block 611 into longitudinal member 680 to remove toner from longitudinal member 680. In another embodiment, when stop 678 and end block 611 apply the selected forces against each other, a mechanical wave is created in end block 611 and a corresponding mechanical wave is created in the air adjacent to end block 611, and the mechanical wave in the air travels towards longitudinal member 680 to remove the toner. The wave motions of these embodiments correspond to the wave motions shown in FIG. 6B.

Figure 7:
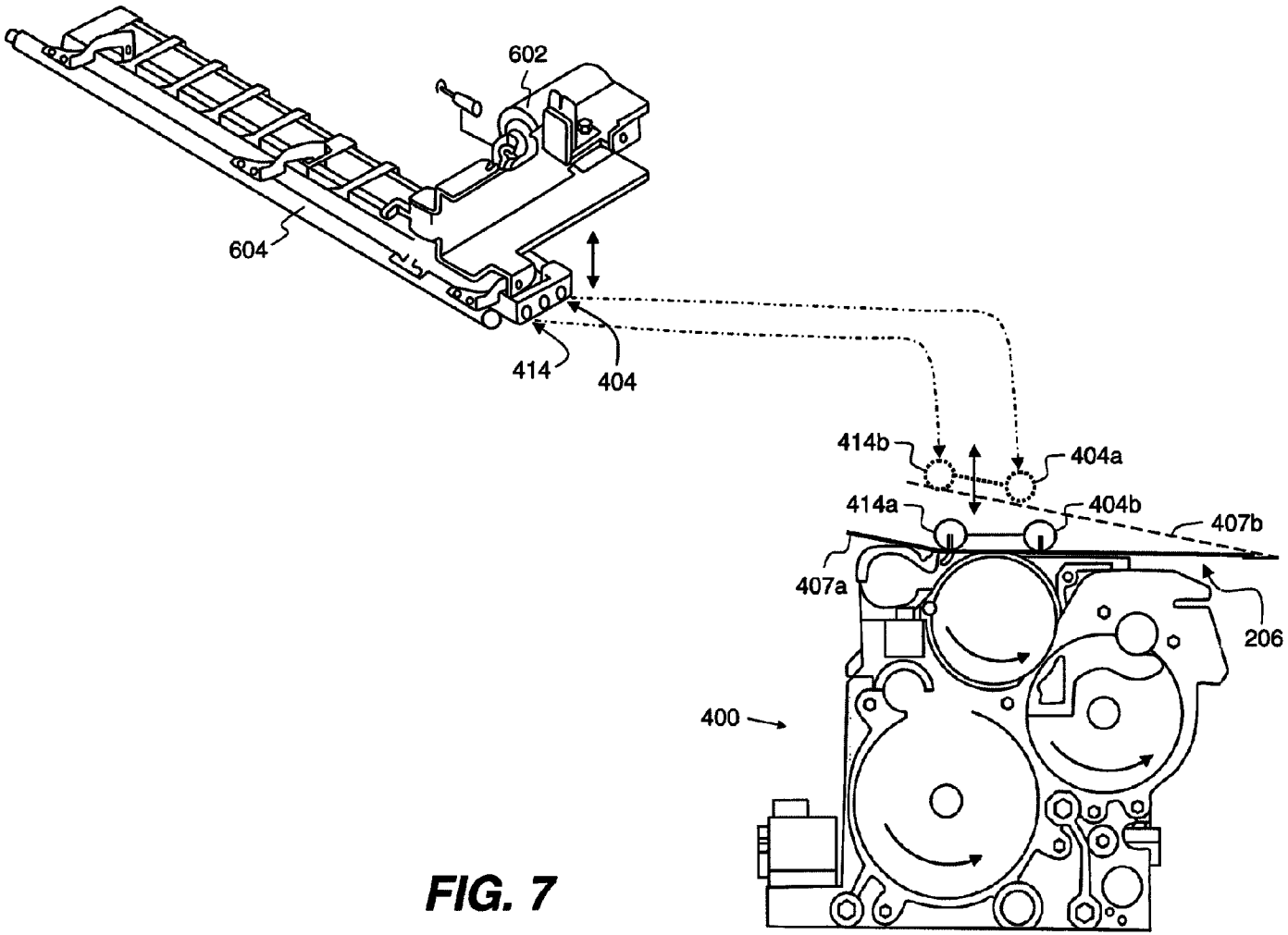
FIG. 7 shows detail of the toning station of FIG. 4 and associated components, including two positions of the backup bar, according to an embodiment of the present invention.

FIG. 7 shows toning station 400 and associated components. Backup bars 404, 414 and image loop 407 are as shown in FIG. 4. Solenoid 602 and backup assembly 604 are as shown in FIG. 6A. Backup bars 404, 414 are shown in first position 404*a*, 414*a* respectively, and in second position 404*b*, 414*b* respectively. Photoreceptor 206 and development member 403 are as shown in FIG. 5. In an embodiment, backup assembly 604 translates vertically to move backup bars 404, 414 between first positions 404*a*, 414*a* and second positions 404*b*, 414*b* respectively. Backup bar 404 (and likewise backup bar 414) is operative in second position 404*b* to be spaced apart from image loop 407 and photoreceptor 206 to reduce unwanted toning of photoreceptor 206. Backup bar 414 is likewise operative in second position 414*b*. In various embodiments, photoreceptor 206 is compliant, or is mounted on a compliant member (e.g. a spring) to permit it to disengage from development member 403 when backup bar 404 is operated in the second position. Backup bar 404 can have a travel time between first position 404*a* and second position 404*b* of <250 ms, <100 ms, or approximately 70 ms. Image loop 407 (FIG. 4) is shown in first position 407*a* corresponding to first positions 404*a*, 414*a*; and in second position 407*b* corresponding to first positions 404*b*, 414*b*. Photoreceptor 206 is disposed over the side of image loop 407 opposite backup bars 404, 414.

In various embodiments, one of backup bar 404 or end block 611 moves and the other is stationary, or both backup bar 404 and end block 611 move. Backup bar 404 can move and end block 611 can be stationary. Alternatively, end block 611 can move and backup bar 404 can be stationary. In an embodiment, photoreceptor 206 is a web photoreceptor, backup bar 404 moves, and end block 611 is stationary. In another embodiment, photoreceptor 206 is a drum photoreceptor, end block 611 moves, and backup bar 404, which serves as a stop, is stationary.

Referring to FIG. 7 and also to FIG. 4, controller 406 (FIG. 4) is responsive to timing device 416. When the interval measured by timing device 416 reaches the selected interval, the controller causes backup bar 404 (and 414, in embodiments) to be in the second position, then, after a selected delay, to be in the first position. Backup bar 404 therefore applies an impulse to end block 601 (FIG. 6A), i.e. it applies a selected force to end block 601 for a selected time. Toner on skive mount 503 (FIG. 5) or any other longitudinal member 680 (FIG. 6C) attached to end block 601 is therefore removed or dislodged by an avalanche triggered by the mechanical wave that results from the impulse as the wave travels through end block 601 into skive mount 503 (FIG. 5), as described above with respect to FIG. 6B.

In various embodiments, controller 406 is effective when the measured time interval reaches the selected time interval to automatically operate actuator 696 (FIG. 6C). Controller 406 causes photoreceptor 206 and development member 403 to be spaced apart. Then, after a selected time delay, controller 460 causes the photoreceptor and development member to be brought into operational relationship, as described above, so that stop 678 (FIG. 6C) and end block 601 apply selected forces against each other to cause toner on longitudinal member 680 to be removed.

As discussed above, toner is removed after an interval selected so that the toner build-up on the longitudinal member is not enough to cause spontaneous avalanches of toner onto development member 403 before the controlled avalanche caused at the selected interval. The selected time delay during which the backup bar is in the second position, or photoreceptor 206 and development member 403 are spaced apart, can be selected by one skilled in the art based on throughput, latency and productivity requirements of the system, the motion characteristics of the moving parts (including acceleration and deceleration), and the required impulse (force, time) to remove toner from longitudinal member 680.

Referring to FIG. 7, in an embodiment, solenoid 602 is controlled by controller 406 (FIG. 4). Backup assembly 604 is connected to and driven by solenoid 602. Backup assembly 604 holds backup bars 404, 414 so that solenoid 602 operates the backup bars and moves them between the first and second positions. In various embodiments, backup assembly 604 includes a cam or linkage connected to solenoid 602.

Figure 8:
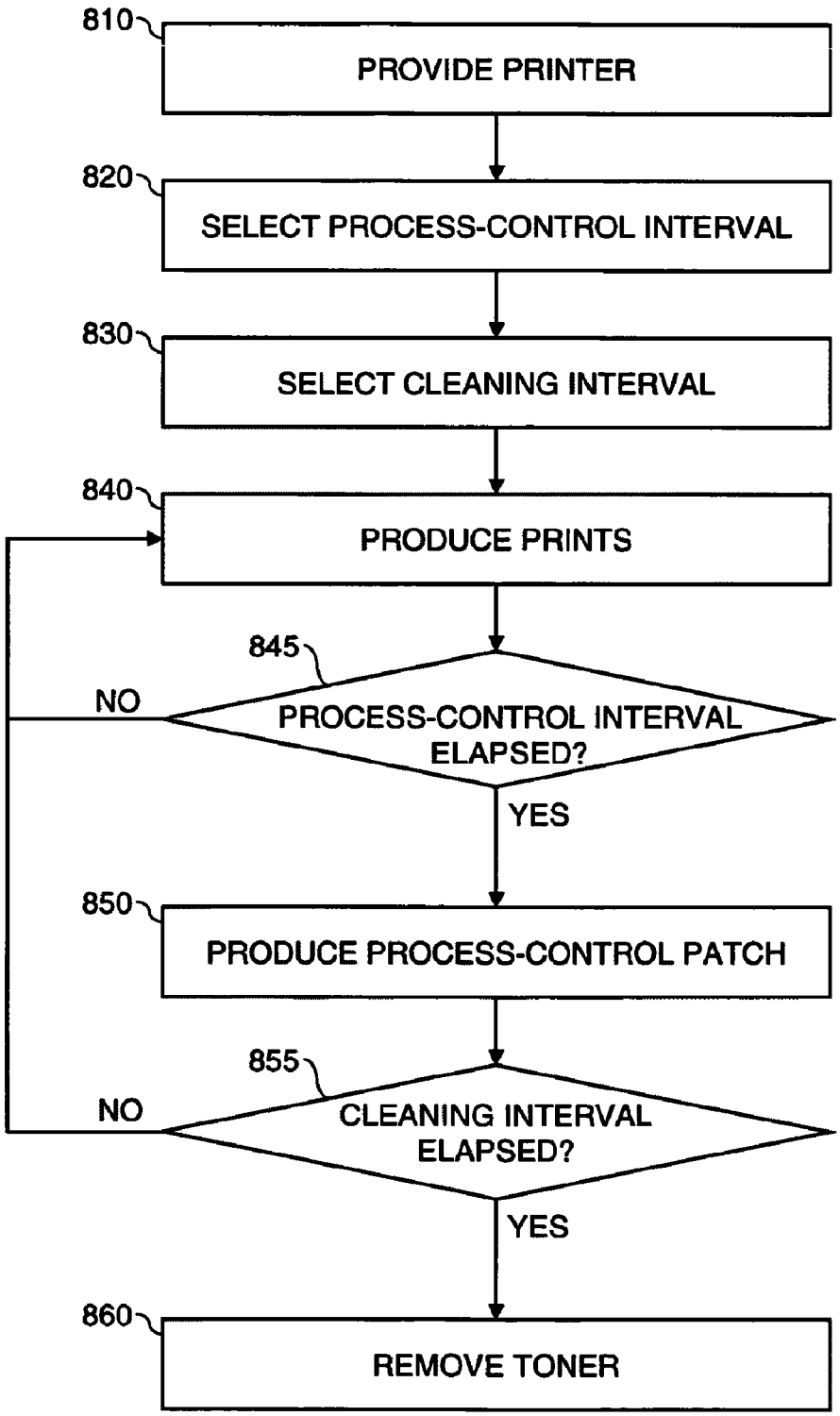
FIG. 8 is a flowchart of a method of removing toner useful with the present invention.

FIG. 8 is a flowchart of a method useful with the present invention. Processing begins with step 810. In step 810, the printer is provided, in an embodiment having the components described above with reference to FIGS. 4-7. Specifically, the printer includes a rotatable development member, an end block disposed at one end of the development member, and a timing device for measuring intervals of printer operation. In one embodiment, the printer also includes a skive mount adjacent to the development member and connected to the end block and a backup bar operative in a first position to make physical contact with at least one point on the end block, and operative in a second position to be spaced apart from the photoreceptor. In another embodiment, the printer also includes a stop disposed at one end of the photoreceptor; a longitudinal member adjacent to the development member or photoreceptor, connected to the end block, and extending along the width of the development member or photoreceptor; and an actuator for selectively causing the development member to be spaced apart from the photoreceptor or be brought into operational relationship with the photoreceptor. Step 810 is followed by step 820.

In step 820, a process-control interval is selected. This can be a specific number of frames, e.g. 100, 200, 300 or 400. This can also be a number of seconds of operation or sheets printed, e.g. 100, 200, 300 or 400. Step 820 is followed by step 830.

In step 830, a cleaning interval that is a positive multiple of the process-control interval is selected. For example, the cleaning interval can be 1×, 2×, 3×, 10×, 15×, 20× or 50× the process-control interval. The process-control interval can be 200 sheets printed, and the cleaning interval can be 15× (15 times the process-control interval)=3,000 sheets printed. The cleaning interval can be a positive integer multiple of the process-control interval, or a specific number of frames. Step 830 is followed by step 840.

In step 840, prints are produced using the printer until the process-control period elapses, as measured by the timing device. Step 840 is followed by decision step 845. Decision step 845 decides whether the process-control interval has elapsed. If it has, the next step is step 850. If not, the next step is step 840.

In step 850, a process-control patch is produced in a process-control frame. Step 850 is followed by decision step 855. Decision step 855 decides whether the cleaning interval has elapsed. If so, the next step is step 860. If not, the next step is step 840. That is, prints are produced (step 840) and process-control patches are run (step 850) until the cleaning interval has elapsed, as measured by the timing device.

In step 860, toner is removed from the longitudinal member. In an embodiment, the backup bar is operated to remove toner from the skive mount. In the process-control frame or in a subsequent skip frame, the backup bar is operated in the second position, then, after a selected delay, in the first position, so that toner is removed from the skive mount. The selected delay can be zero or greater than zero. In another embodiment, in the process-control frame, the actuator is automatically operated to cause photoreceptor 206 and development member 403 (FIG. 5) to be spaced apart. Then, after a selected time delay, photoreceptor 206 and development member 403 are caused to be brought into operational relationship as described above, so that stop 678 (FIG. 6C) contacts end block 611 (FIG. 6C), and toner is removed from longitudinal member 680 (FIG. 6C)0.

Figure 9:
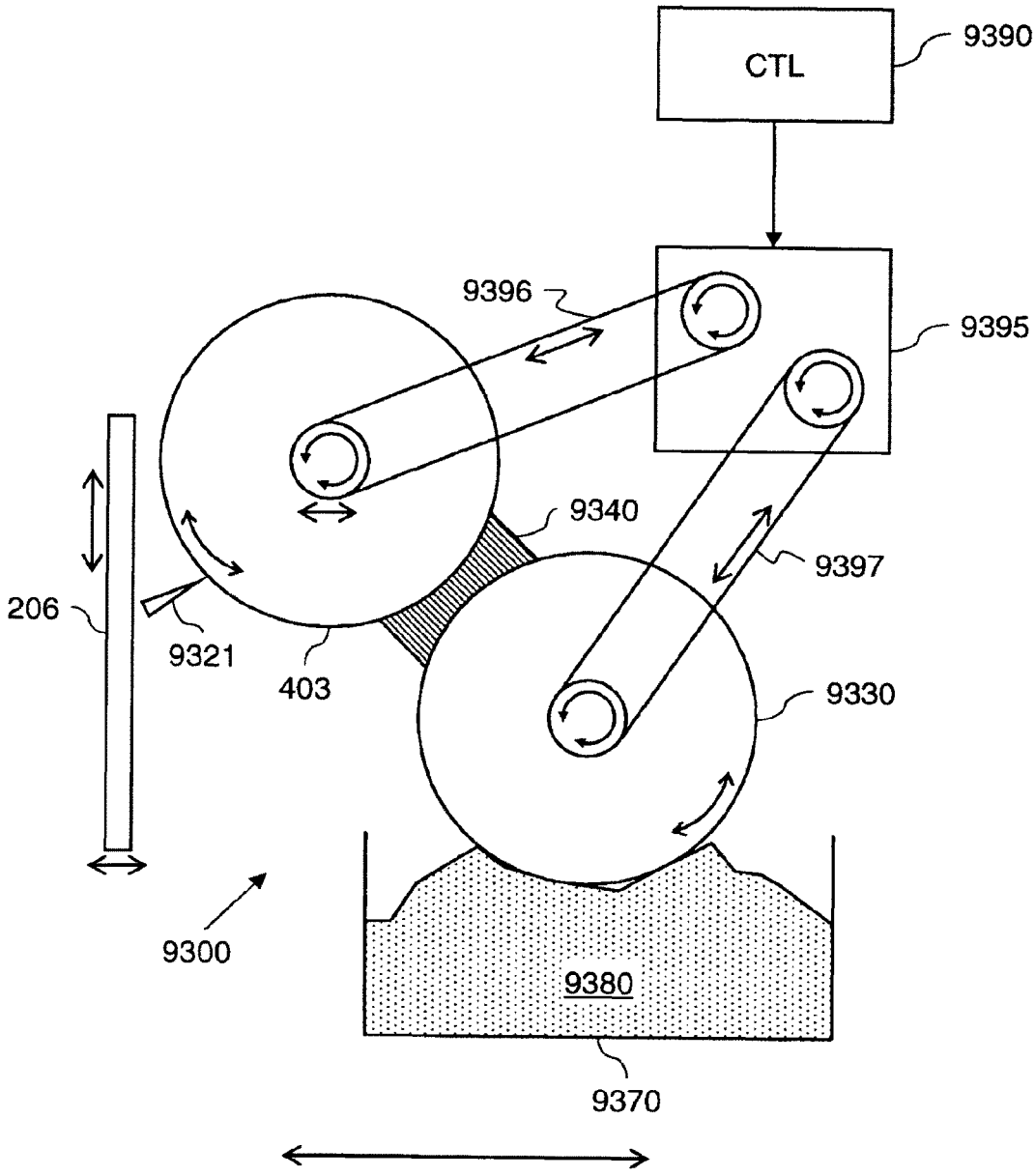
FIG. 9 is an elevational cross-section of another electrophotographic reproduction apparatus suitable for use with this invention.

FIG. 9 shows a side elevation of an embodiment of an electrophotographic printing apparatus useful with the present invention. Print engine 9300 is adapted to apply or deposit toner 9380 on a receiver (not shown) to form a print image. The print image is formed from a visible image on photoreceptor 206. Photoreceptor 206 can be a sheet, belt, or drum. Print engine 9300 includes development member 403 and supply member 9330 disposed so that toner and charge are transferred between the members in a charge-transfer region 9340. Each member is a roller and is preferably substantially circular in cross-section. In an embodiment, photoreceptor 206 can translate horizontally to engage and disengage Charge-transfer region 9340 is not a physical part of print engine 9300; it is a region of space in which the electric fields between development member 403 and supply member 9330 are strong enough to move charge between the two. The rotation of supply member 9330 and development member 403, in the presence of toner 9380 in charge-transfer region 9340, with the assistance of development blade 9321, results in an approximately uniform coat of toner 9380 on development member 403.

Development blade 9321 mechanically levels the toner coat on development member 403 by scraping off any toner peaks farther from the surface of development member 403 than development blade 9321. Charge-transfer region 9340 has a higher charge density than other regions on supply member 9330 and development member 403 because toner 9380 on supply member 9330 is tribocharged in this region. Supply member 9330 collects toner 9380 mechanically by van der Waal's forces, and electrostatically using a bias voltage which attracts residual charge or tribocharge on toner 9380. Toner 9380 is transferred from supply member 9330 to development member 403 by electric fields due to respective, different bias voltages applied to supply member 9330 and development member 403.

Controller 9390 controls actuator 9395, which in response to controller 9390 selectively rotates members 403, 9330 using belts 9396, 9397 respectively.

Toner 9380 is supplied from toner supply 9370 to supply member 9330. Supply member 9330 provides toner to development member 403. Development member 403 provides toner to photoreceptor 206, where it adheres to the appropriate parts of the latent image to form a visible image. The adhered toner is then transferred to a receiver (not shown) to form the print image.

In an embodiment, a supply of monocomponent developer adapted to be applied by the EP print engine to the receiver is provided. The developer includes toner particles, and includes less than 1% magnetic carrier particles.

In an embodiment, development member 403 and supply member 9330 are belts entrained around members, as is known in the art.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

| | |
|---|---|
| 31, 32, 33, 34, 35 | printing module |
| 38 | print image |
| 39 | fused image |
| 40 | supply unit |
| 42, 42A, 42B | receiver |
| 50 | transfer subsystem |
| 60 | fuser |
| 62 | fusing roller |
| 64 | pressure roller |
| 66 | fusing nip |
| 68 | release fluid application substation |
| 69 | output tray |
| 70 | finisher |
| 81 | transport web |
| 86 | cleaning station |
| 99 | logic and control unit (LCU) |
| 100 | printer |
| 102, 103 | roller |
| 104 | transmission densitometer |
| 105 | power supply |
| 109 | interframe area |
| 110 | light beam |
| 111, 121, 131, 141, 151 | imaging member |
| 112, 122, 132, 142, 152 | transfer member |
| 113, 123, 133, 143, 153 | transfer backup member |
| 124, 125 | corona tack-down chargers |
| 201 | transfer nip |
| 202 | second transfer nip |
| 206 | photoreceptor |
| 210 | charging subsystem |
| 211 | meter |
| 212 | meter |
| 213 | grid |
| 216 | surface |
| 220 | exposure subsystem |
| 225 | development station |
| 226 | toning shell |
| 227 | magnetic core |
| 228 | sump |
| 240 | power source |
| 400 | toning station |
| 401 | blender |

-continued

| PARTS LIST | |
|---|---|
| 402 | roller |
| 403 | development member |
| 404, 414 | backup bar |
| 404a, 414a | backup bar first position |
| 404b, 414b | backup bar second position |
| 405 | encoder |
| 406 | controller |
| 407, 407a, 407b | image loop |
| 416 | timing device |
| 420 | toner supply |
| 451 | transfer roller |
| 452 | registration roller |
| 501 | replenisher assembly |
| 502 | skive |
| 503 | skive mount |
| 504 | toner bottle |
| 601, 611 | end block |
| 602 | solenoid |
| 603 | internal scavenger |
| 604 | backup assembly |
| 635, 638 | toner |
| 650, 660, 665 | mechanical wave |
| 678 | stop |
| 680 | longitudinal member |
| 696 | actuator |
| 810 | step |
| 820 | step |
| 830 | step |
| 840 | step |
| 845 | decision step |
| 850 | step |
| 855 | decision step |
| 860 | step |
| 1951 | area |
| 1986 | comet |
| 9300 | print engine |
| 9321 | development blade |
| 9330 | supply member |
| 9340 | charge-transfer region |
| 9370 | toner supply |
| 9380 | toner |
| 9390 | controller |
| 9395 | actuator |
| 9396 | belt |
| 9397 | belt |
| $R_n$-$R_{(n-6)}$ | receivers |

The invention claimed is:

1. Apparatus for removing toner after a selected time interval from a longitudinal member in a dry electrophotographic printer for printing a visible image on a receiver, comprising:

a) a rotatable photoreceptor for transferring the visible image comprising toner onto the moving receiver;

b) a rotatable development member arranged with respect to the photoreceptor to provide toner to the photoreceptor, and an end block disposed at one end of the rotatable development member;

c) a toner supply arranged with respect to the development member to apply a blanket of developer to the development member, wherein the developer includes toner;

d) a longitudinal member disposed adjacent to the development member or photoreceptor, connected to the end block, and extending along the width of the development member or photoreceptor;

g) a backup bar disposed adjacent to the photoreceptor, the backup bar operative in a first position to make physical contact with at least one point on the end block, so that the photoreceptor is retained in position with respect to the development member to receive toner from the development member, and operative in a second position to be spaced apart from the photoreceptor;

h) a timing device for measuring a time interval of printer operation; and i) a controller responsive to the timing device and effective when the measured time interval reaches the selected time interval to automatically cause the backup bar to be in the second position, then, after a selected time delay, to cause the backup bar to be in the first position, so that the backup bar applies a selected force to the end block to cause toner on the longitudinal member to be removed from such member, wherein when the backup bar applies a selected force to the end block, a mechanical wave is created in the end block and the mechanical wave travels through the end block into the longitudinal member to remove the toner.

2. The apparatus according to claim 1, wherein one of the backup bar or the end block moves and the other is stationary.

3. The apparatus according to claim 1, further including a skive disposed adjacent to the development member between the toner supply and the photoreceptor in the direction of rotation of the development member, wherein the longitudinal member is a skive mount connecting the skive to the end block.

4. The apparatus of claim 3, wherein the skive controls the quantity of developer material delivered from the toner supply to the development zone.

5. The apparatus according to claim 1, wherein the longitudinal member is a scavenger.

6. The apparatus of claim 1, wherein the toner supply includes a sump, a feed roller, a feed auger, or a plurality of paddles on a non-helical roller.

7. The apparatus of claim 1, further including a second end block disposed at the opposite end of the development member from the first end block.

8. The apparatus of claim 1, further including a second backup bar arranged parallel to, and spaced apart from, the backup bar, so that the operation of the second backup bar corresponds to the operation of the first backup bar.

9. The apparatus of claim 1, wherein the photoreceptor is a web photoreceptor.

10. The apparatus of claim 1, wherein the developer is a two-component developer that includes toner particles and magnetic carrier particles.

11. Apparatus for removing toner after a selected time interval from a longitudinal member in a dry electrophotographic printer for printing a visible image on a receiver, comprising:

a) a rotatable photoreceptor for transferring the visible image comprising toner onto the moving receiver, and a stop disposed at one end of the rotatable photoreceptor;

b) a rotatable development member arranged with respect to the photoreceptor to provide toner to the photoreceptor, and an end block disposed at one end of the rotatable development member;

c) a toner supply arranged with respect to the development member to apply a blanket of developer to the development member, wherein the developer includes toner;

d) a longitudinal member disposed adjacent to the development member or photoreceptor, connected to the end block, and extending along the width of the development member or photoreceptor;

g) an actuator for selectively causing the photoreceptor to be spaced apart from the development member or to be brought into operational relationship with the development member;

h) a timing device for measuring a time interval of printer operation; and i) a controller responsive to the timing device and effective when the measured time interval reaches the selected time interval to automatically operate the actuator to cause the photoreceptor and development member to be spaced apart, then, after a selected time delay, to cause the photoreceptor and development member to be brought into operational relationship, so that the stop and end block apply selected forces against each other to cause toner on the longitudinal member to be removed.

12. The apparatus according to claim 11, wherein when the stop and end block apply the selected forces against each other, a mechanical wave is created in the end block and the mechanical wave travels through the end block into the longitudinal member to remove the toner.

13. The apparatus according to claim 11, wherein when the stop and end block apply the selected forces against each other, a mechanical wave is created in the end block and a corresponding mechanical wave is created in the air adjacent to the end block, and the mechanical wave in the air travels towards the longitudinal member to remove the toner.

14. The apparatus of claim 13, further including a solenoid controlled by the controller and connected to the movable member to operate the movable member.

15. The apparatus of claim 13, further including a solenoid controlled by the controller and connected to the movable member to operate the movable member.

16. The apparatus according to claim 11, wherein one of the stop or the end block is a movable member and the other is a stationary member.

17. The apparatus of claim 11, wherein the photoreceptor is a drum photoreceptor.

18. The apparatus of claim 11, wherein the developer is a two-component developer that includes toner particles and magnetic carrier particles.

19. Apparatus for removing toner after a selected time interval from a longitudinal member in a dry electrophotographic printer for printing a visible image on a receiver, comprising:

a) a rotatable photoreceptor for transferring the visible image comprising toner onto the moving receiver;

b) a rotatable development member arranged with respect to the photoreceptor to provide toner to the photoreceptor, and an end block disposed at one end of the rotatable development member;

c) a toner supply arranged with respect to the development member to apply a blanket of developer to the development member, wherein the developer includes toner;

d) a longitudinal member disposed adjacent to the development member or photoreceptor, connected to the end block, and extending along the width of the development member or photoreceptor;

g) a backup bar disposed adjacent to the photoreceptor, the backup bar operative in a first position to make physical contact with at least one point on the end block, so that the photoreceptor is retained in position with respect to the development member to receive toner from the development member, and operative in a second position to be spaced apart from the photoreceptor;

h) a timing device for measuring a time interval of printer operation; and i) a controller responsive to the timing device and effective when the measured time interval reaches the selected time interval to automatically cause the backup bar to be in the second position, then, after a selected time delay, to cause the backup bar to be in the first position, so that the backup bar applies a selected force to the end block to cause toner on the longitudinal member to be removed from such member, wherein when the backup bar applies a selected force to the end block, a mechanical wave is created in the end block and a corresponding mechanical wave is created in the air adjacent to the end block, and the mechanical wave in the air travels towards the longitudinal member to remove the toner.

* * * * *